US005705304A

United States Patent [19]

Sugita et al.

[11] Patent Number: 5,705,304

[45] Date of Patent: Jan. 6, 1998

[54] PHOTO-REMOVABLE ELECTROPHOTOGRAPHIC TONERS USING PHENYL ISOPROPENYL KETONE

[75] Inventors: Kazuyuki Sugita, Chiba-ken; Ken-ichi Kishi; Hirofumi Iemura, both of Tokyo, all of Japan

[73] Assignees: Toyo Ink Manufacturing Co., Ltd., Tokyo; Kazuyuki Sigita, Chiba-ken, both of Japan

[21] Appl. No.: 504,684

[22] Filed: Jul. 20, 1995

[30] Foreign Application Priority Data

Feb. 10, 1995 [JP] Japan ..... 7-022594

[51] Int. Cl.[6] ..... G03G 9/087

[52] U.S. Cl. ..... 430/109; 430/106; 430/110

[58] Field of Search ..... 430/106, 109, 430/110, 114

[56] References Cited

U.S. PATENT DOCUMENTS

| | | | |
|---|---|---|---|
| 3,860,538 | 1/1975 | Guillet et al. | 525/199 |
| 4,298,672 | 11/1981 | Lu | 430/108 |
| 5,232,808 | 8/1993 | Bonser et al. | 430/110 |
| 5,326,792 | 7/1994 | Masaki et al. | 522/135 |
| 5,545,381 | 8/1996 | Iida et al. | 422/186 |

FOREIGN PATENT DOCUMENTS

| | | | |
|---|---|---|---|
| 61-122655 | 6/1986 | Japan . | |
| 63-316063 | 12/1988 | Japan | 430/110 |
| 2-166114 | 6/1990 | Japan . | |
| 5-61246 | 3/1993 | Japan . | |
| 5-134448 | 5/1993 | Japan . | |
| 6-19215 | 1/1994 | Japan . | |
| 59-11902 | 3/1994 | Japan . | |
| 6-102802 | 4/1994 | Japan . | |

OTHER PUBLICATIONS

Patent & Trademark Office English–Language Translation Of JP 5–61246 (Pub. Mar. 12, 1993).

Derwent Abstract 93–122255 (1993) Of JP 5–61246 (Pub Mar. 1993).

J. Kosar "Chemistry & Application Of Nonsilver Halide Photographic Process" (1965) J. Wiley & Sons NY p. 145.

Japio abstract 57–37353 (A), Mar. 1, 1982.

Japio abstract 5–134448 (A), May 28, 1993.

Japio abstract 6–19215 (A), Jan. 28, 1994.

Japio abstract, 61–122655 (A), Jun. 10, 1986.

K. Sugita et al., Journal of Polymer Science, vol. 14 1901–1913 (1976); "Photochemistry of Ketone Polymers. XII. Studies of Ring–Substitued Phenyl Isopropenyl Ketones and Their Styrene Copolymers".

K. Sugita et al., Polymer Journal, vol. 25, No. 10, pp.1059–1067 (1993); "UV Characteristics and Performance as Positive–Working Deep, Mid, and Near UV resists of Phenyl Isopropenyl Ketone Copolymers".

*Primary Examiner*—Janis L. Dote

*Attorney, Agent, or Firm*—Knobbe, Martens, Olson & Bear, LLP

[57] ABSTRACT

Electrophotographic toners comprising a resin, a colorant, a charge controlling agent and an offset preventing agent. The resin comprises a copolymer containing at least one of phenyl isopropenyl ketone and its derivatives as a constituting monomer. The copolymer is photodegradable and thus the toners can be are used for recycling paper.

8 Claims, No Drawings

PHOTO-REMOVABLE ELECTROPHOTOGRAPHIC TONERS USING PHENYL ISOPROPENYL KETONE

BACKGROUND OF THE INVENTION

1. Field of the Invention

The present invention relates to electrophotographic toners, in particular photodegradable electrophotographic toners. More specifically, the invention relates to electrophotographic toners suitable for recycling paper.

2. Description of the Related Art:

Nowadays, increase in quantity of information and transmission thereof are bringing about frequent use of various types of outputting machines, such as a copying machine, a laser printer and a facsimile. As a matter of fact, if there are no these machines, social activities do not make efficient and smooth progress. However, it is also true that, as the amount of paper to be used is on the increase because of increase in frequency of using these machines, social problems of destruction of forest resources and waste paper in cities become serious.

In order to resolve these problems, a paper less system is being introduced which involves use of recording media such as a magnetic tape, a floppy disk and an optical disk. However, confirmation is generally made by use of paper on which characters or images are conventionally printed. Thus, the amount of used paper is still on the increase.

Against the problem of increase in waste paper in cities, local governments are promoting separate recovery of paper for the purpose of recycling paper. It has attached moderate or suitable results. However, the results are not yet satisfactory.

In the meantime, among the above-mentioned outputting machines, an electrophotographic type machine is preferably used at present in the light of printing quality, printing speed, color-adaptability, and freedom of using various types of paper. Also, it is foreseen that frequency of using this type machine will further increase from now on.

One attempt for overcoming the above-mentioned problems in the electrophotographic system is to use, what is called, a color-vanishing toner, which is disclosed in, for example, JP-A-5-134448. Characters or images made from this type toner by a copying machine can be vanished by irradiation of light having a specific wavelength.

This permits the paper on which characters or images are vanished to be re-used, and makes it possible to save paper resources.

However, an electrophotographic developer containing this color-vanishing toner has some drawbacks, as described below, owing to electrophotography.

Electrophotographic systems are classified into some types. The type in which the color-vanishing toner is preferably used is, what is called, a two-component developer type. The process of this type involves use of a two-component developer comprising a mixture of carrier particles containing, for example, glass beads and iron particles, and toner particles containing, as the main ingredients, a resin, a colorant, a charge controlling agent and an offset preventing agent. In this two-component developer, fine toner particles are supported on a relatively large carrier particle by means of electrostatic force generated by friction between the particles of the two types. When the developer gains access to an electrostatic latent image, absorbing force toward the latent image is applied to the toner particles by electric field caused by the electrostatic latent image. Then, the absorbing force becomes stronger than binding force between toner particles and carrier particles, so that the toner particles are adsorbed and bound to the electrostatic latent image. As a result, this latent image is visualized. The developing agent is used repeatedly, with toner particles being replenished in amount that is consumed by development.

Thus, during use of the developer for a long time, the carrier always needs to cause the toner particles to be frictionally charged and polarized at a sufficient charge level. However, this developer containing the color-vanishing toner does not have a stable frictional-charge property, in the environment of high humidity, because of hydrophility resulted from a quaternary ammonium salt, as is easily imagined from the chemical structure of a vanishable colorant in the color-vanishing toner. In other words, stable copies cannot be obtained in the environment of high humidity, such as in the atmosphere on a rainy day.

Furthermore, after characters or images, on a printing paper, made from a color-vanishing toner have been vanished, the paper looks white; however, on the paper there remains the color-vanished toner. Thus, by making a copy on this paper, the surface of a photosensitive material in a copying machine is contaminated to deteriorate an electric property of the photosensitive material. As a result, a stable and high quality copy cannot be obtained.

As for a resin for electrophotographic toners, there are preferably used a crosslinking polyester resin as disclosed in, for example, JP-B-59-11902 and a styrene-acrylic type resin having a wide molecular-distribution as disclosed in JP-A-56-16144, because of, for example, fixing properties and charging properties thereof.

However, these resins are strong due to the natures resulted from the crosslinks and the molecular-distribution, so that materials printed by toners containing these resins are very poor in a toner-removal character during a paper-reproducing step. For this reason, there is a problem that stains, such as black spots originated from undissolved toners, appear in the step of making paper.

In addition, regarding vanishing-color toners, it is difficult to obtain a color toner having any color. They cannot be therefore adapted to marketing tendency, in the future, that color copies exhibiting good color-reproductivity are preferred.

SUMMARY OF THE INVENTION

Therefore, it is the first object of the present invention to provide electrophotographic toners by which characters or images printed on a printing material can be removed only by physical action such as blowing compressed air, bending, folding, or rubbing, after irradiation of light, in particular ultraviolet ray, to the material, thereby making recycle of paper possible.

It is the second object to provide toners for a high quality, economical two-component developer by which stable images can be obtained, even by use for a long time in the environment of high humidity.

It is the third object to provide toners for a high quality, economical two-component developer by which the surface of a photosensitive material is not contaminated and by which stable images can be obtained even by use for a long time.

It is the fourth object to provide color toners which can be adapted to color printing and which have a good color reproductivity.

The present invention, which can accomplish the above objects, provides electrophotographic toners comprising a resin, a colorant, a charge controlling agent and an offset preventing agent, the resin comprising a copolymer containing at least one of phenyl isopropenyl ketone and its derivatives as a constituting monomer.

In a preferred embodiment, the resin is a mixture of a polyester type resin and a styrene-acrylic type resin and the styrene-acrylic type copolymer resin contains at least one of phenyl isopropenyl ketone and its derivatives as a constituting monomer.

In electrophotographic toners exhibiting color-reproductivity, the colorant is at least one organic colorant selected from phthalocyanine, quinacridone, benzidine, rhodamine, and insoluble azo types. Preferably, the electrophotographic toners of the present invention further comprise a photosensitizer.

DESCRIPTION OF THE PREFERRED EMBODIMENTS

The toners of the present invention can be prepared by use of a specific, photodegradable copolymer as a resin ingredient. This is a photodegradable copolymer comprising phenyl isopropenyl ketone as a constituting monomer. Those skilled in the art can easily obtain this copolymer by the following method. (In the present invention, the copolymer is referred to as a polymer comprising two or more constituting monomers, and thus includes, for example, terpolymers.)

The copolymer can be obtained by Mannich reaction of a substituted or unsubstituted propiophenone to give an amino product, deamination of the amino product to yield a substituted or unsubstituted phenyl isopropenyl ketone, and then copolymerization of this ketone with one or more monomers such as styrene, acrylic ester, and/or (meth) acrylic acid in the presence of a polymerization initiator, as described in detail in documents published by the inventors, i.e., K. Sugita et al., JOURNAL OF POLYMER SCIENCE Polymer Chemistry Edition 14 1901–1913 (1976) and K. Sugita et al., Polymer Journal, Vo., 25, No. 10. 1059–1067 (1993).

A phenyl group of phenyl isopropenyl ketone used in the invention is substituted or unsubstituted. The substituent includes alkyl, alkoxy, alkoxycarbonyl and acyl, each of which has 1–4 carbon atoms, halogen such as chlorine or bromine, cyano, nitro, amino, hydroxy and carboxy.

The phenyl isopropeny ketone content in the copolymer used in the present invention, which is not limited, can be easily decided, depending on a type of monomer to be copolymerized and in view of adaptability to a desired electrophotographic process.

For example, the amount of phenyl isopropenyl ketone is, for example, 1–50%, preferably 5–40% by mole of the copolymer.

As another monomer or other monomers which constitute the copolymer, various types of polymers can be used, if they are copolymerized with phenyl isopropenyl ketone to produce a resin which can exhibit photodegradation and adhesion by heating. They include, for example, styrene, ethylene, propylene, vinyltoluene, (meth)acrylic acid, (meth)acrylic acid derivatives, maleic acid, maleinimide, vinyl chloride, vinyl acetate, vinylphenol, and vinylphenol derivatives.

The resin used in the invention may be the above photodegradable copolymer mixed with another resin or other resins. A type of the resin (s) and a mixing ratio of the resin(s) to the copolymer are not limited, if the characteristics of the copolymer, i.e., photodegradation and adhesion by heating, can be exhibited to a desired extent or can be improved.

Specifically, a preferred resin used in the invention is a styrene-acrylic type copolymer resin which contains phenyl isopropeny ketone as a constituting monomer. A styrene type monomer and an acrylic type monomer which constitute this preferred resin may be selected from any types known in the art.

The molar ratio of substituted or unsubstituted styrene to an acrylic type monomer to phenyl isopropenyl ketone, which are contained in the copolymer, is, for example, 10–70:5–70:5–60, preferably, 20–50:15–50:30–40.

It is more preferred that the above styrene-acrylic type copolymer resin is mixed with a polyester type resin.

The polyester type resin may be selected from any types known in the art, and is preferably a polyester resin comprising etherified diphenol, dicarboxylic acid or lower alkyl ester thereof, and poly(i.e., tri or more)carboxylic acid or anhydride thereof; or a polyester resin comprising rosin glycyl ester and di- or polycarboxylic acid.

It is preferred that the weight ratio of the polyester resin to the photodegradable copolymer in the toners of the invention is 0.7 or less. If the weight ratio is over 0.7, the photodegradability of the toners decreases and thus advantageous effects of the invention cannot be exhibited.

The amount of the resin used in the invention is in general 5–100%, preferably 20–100% by weight of the toner.

As the colorant, use is made of carbon black, various types of dyes and pigments, alone or in combination. To obtain black toners can be easily attained by use of carbon black or a blue black type pigment alone, or by combined use thereof. In order to obtain toners having any other color, it is convenient to use a dye or pigment having the corresponding color.

In the light of color reproductivity, resistance against color fading-out, an electrophotographic property, preferable cyan colorants include phthalocyanine types, in particular, C.I. 74160 (Color Index No. 74160), C.I. 74180, C.I. 74255, C.I. 74260 and C.I. 74280, and preferable yellow colorants include benzidine type colorants, in particular C.I. 20190. C.I. 21095, C.I. 21100, Pigment Yellow 12, Pigment Yellow 13, Pigment Yellow 14, Benzidine Yellow G, Benzidine Yellow I.G, Benzidine Yellow OT, Vulcan fast yellow G, Permanent Yellow GR, Symuler fast Yellow 5GF. Dyes or pigments having magenta color, as well as the above cyan and yellow colorants, are used in full color electrophotography. Preferable magenta dyes or pigments include quinacridone types, in particular C.I. 73915; rhodamine types, in particular C.I. 45160; and insoluble azo types, in particular C.I. 15850.

The amount of the dye/pigment used in the invention, which is a level necessary for color reproductivity, may be usually from 2 to 10% by weight of the toner.

As the charge controlling agent, there may be used, for example, an azo type pigment, a metallic chelate of a salicylic acid type compound, Nigrosine pigment, or a compound such as a quaternary ammonium salt, or a mixture thereof. Any type and amount which give damage to color reproductivity should not be used. The amount of the charge controlling agent is usually 0.3–5% by weight of the toners.

As the offset preventing agent, there may be used, for example, a synthetic or natural wax such as an ethylene type wax, propylene type wax, carnauba wax, rice oil, a mixture thereof. The amount thereof may be usually from 2 to 10% by weight of the toner.

In the electrophotographic toners of the present invention, preferably a photosensitizer is incorporated into the toners, whereby photodegradation is progressed more smoothly.

The amount of the photosensitizer may be usually 0.01–20%, preferably 0.5–5% by weight of the toner.

The photosensitizer which may be used in the invention includes a compound which has a function which can transfer excitation energy, such as Michler's ketone, 4,4'-bis(diethylamino)-benzophenone or thioxanthones; and a compound in which hydrogen can be easily abstracted, such as N-phenylglycine, N-methylpyrrolidone, 1,2,3-triphenylguanidine, N,N-dimethylaniline, piperidine, triethylamine or dimethylaminoethanol; and a mixture thereof.

Additives may be added into the toners of the invention. The additives include a fluidity improving agent, a cleaning improving agent, and a resistance controlling agent.

The photodegradable electrophotographic toners of the invention can be obtained by mixing the above resin, colorant, charge controlling agent and offset preventing agent, and optionally a photosentitizer and additive(s). In other words, the toners can be obtained by melting and kneading the above mixture in, for example, a twin screw kneader, cooling it, pulverizing it and optionally classifying the obtained particles into ones having desired particle sizes.

A carrier which may be used together with the toner of the invention is not limited to a specific type. Preferably, there may be used, so-called, a coat carrier, in which a particle of ferrite or magnetite is coated with a resin such as a silicone resin or styrene-acrylic type resin.

The mixing ratio of the toners and carriers varies, depending on, for example, particle sizes of the carrier and the type of a developing process in a copying machine to be used. Appropriately, a toner concentration, i.e., the toner content in a developer is from 1 to 30% by weight.

The function of the toners of the invention is as follows:

A resin which contains phenyl isopropenyl ketone as a constituting monomer is easily degraded by exposure to ultraviolet light, as is evident from the above-mentioned references. Thus, irradiation of ultraviolet light onto images fixed on paper would cause the resin in the images to be degraded into a resin having a lower molecular weight, so that the fixed images are easily stripped off from the paper by physical impact, such as blowing compressed air, bending, folding, rubbing.

EXAMPLES

The present invention will be explained in more detail by the following Preparation Examples and Examples.

Hereinafter, the word "part(s)" refers to "weight part(s)".

Preparation Example 1

Preparation of a copolymer (a) from phenyl isopropenyl ketone:

Into water containing 1 part of ammonium persulfate and 1 part of sodium alkylbenzene sulfonate (trade name: Neopelex F-65, ex Kao Corp.) were dropwise added 200 parts of a mixture of styrene (20% by mole), methyl methacrylate (50% by mole), and phenyl isopropenyl ketone (30% by mole), followed by agitation at 75° C. for 24 hours, so as to yield a copolymer.

100 parts of the obtained copolymer were poured into 1000 parts of a saturated salt water to precipitate a copolymer. The obtained copolymer was well washed with water and dried.

Subsequently, 10 parts of this copolymer were dissolved into 100 parts of chloroform. This solution was poured into methanol of the amount of 10 multiple thereof and filtered to give a copolymer (a).

According to measurement by GPC, the weight average molecular weight of the obtained copolymer was 80,000.

Preparation Example 2

Preparation of a copolymer (b) from phenyl isopropenyl ketone:

A copolymer (b) was prepared in the same manner as in Preparation Example 1, except that the monomers in Preparation Example 1 were replaced by styrene/butyl acrylate/phenyl isopropenyl ketone (mole ratio:50/15/35). The weight average molecular weight thereof was 80,000.

Preparation Example 3:

Preparation of a copolymer (c) from phenyl isopropenyl ketone:

A copolymer (c) was prepared in the same manner as in Preparation Example 1, except that the monomers in Preparation Example 1 were replaced by styrene/butyl acrylate/p-chlorophenyl isopropenyl ketone (mole ratio: 50/15/35). The weight average molecular weight thereof was 80,000.

Example 1:

A formulation having the following composition was subjected to a melting and kneading process, so as to obtain toners of the invention. They had an average particle size of 10 μm.

| | (% by weight) |
|---|---|
| Copolymer (a) | 88 |
| Charge controlling agent: TP-302 (ex Hodogaya Chemical Co., Ltd) | 3 |
| Colorant: Carbon black #44 (ex Mitsubishi Chemical Corporation) | 6 |
| Wax: Mitsui Hi-Wax HWNP505 (ex Mitsui Petrochemical Industries, Ltd) | 2.5 |
| Additive: Silica RA-200H (ex Nippon Aerosil Co., Ltd) | 0.5 |

Example 2:

Toners of the invention were obtained in the same manner as in Example 1, except that the copolymer (b) was used instead of the copolymer (a).

Example 3:

Toners of the invention were obtained in the same manner as in Example 1, except that the copolymer (c) was used instead of the copolymer (a).

Respective toners obtained in the above-mentioned manners were added into ferrite carriers coated with a silicone resin, so that the amount of the toners would be 3.5% by weight of the total. Thus, respective developers were obtained. The respective developers were used to make a continuous copy in a commercial available copying machine FP-3280 (ex Matsushita Electric Industrial Co., Ltd) to obtain 50000 copy papers. These copies were good in image density and fogging, and no filming to the photosensitive material was observed.

Respective papers copy-printed by using the developers from Examples 1, 2 and 3 were permitted to gain access to a mercury lamp (OSRAW-HBO, 250 W) and then were left for 20 minutes. Subsequently, they were rubbed with a brush to strip off almost all of printed characters and images. As a comparative example, copy matters obtained from regular toners for FP-3280 were set in the same condition and rubbed with a brush, so that no changes were observed.

The above papers exposed to ultraviolet light were measured about amounts of their remaining toners, in accordance with a method described in a reference, i.e, Yasuo Ishizaki et al., Japanese Journal of Paper Technology 13–19, 1990, December). As a result, recycling papers based on papers printed by using the toners of the present invention had substantially no remaining toners, while the recycling papers based on papers printed by using the regular toners had many spots having a size of 100 μm, respectively.

Example 4:

A formulation having the following composition was subjected to a melting and kneading process, so as to obtain toners of the invention. They had an average particle size of 10 μm.

| | (% by weight) |
|---|---|
| Copolymer (a) | 50 |
| Polyester resin:Tuftone NE-8030 (ex Kao Corp.) | 38 |
| Charge controlling agent: TRH (ex Hodogaya Chemical Co., Ltd) | 3 |
| Colorant: Carbon black #44 (ex Mitsubishi Chemical Corporation) | 6 |
| Wax: Mitsui Hi-Wax HWNP505 (ex Mitsui Petrochemical Industries, Ltd) | 2.5 |
| Additive: Silica RA-200H (ex Nippon Aerosil Co., Ltd) | 0.5 |

Example 5:

Toners of the invention were obtained in the same manner as in Example 4, except that the copolymer (b) was used instead of the resin used in Example 4.

Example 6:

Toners of the invention were obtained in the same manner as in Example 4, except that the copolymer (c) was used instead of the resin used in Example 4.

Respective toners obtained in the above-mentioned manners were added into carriers coated with a resin of styrene/methyl methacrylate, so that the amount of the toners would be 3.5% by weight of the total. Thus, respective developers were obtained. The respective developers were used to make a continuous copy in commercial available copying machine U-Bix 3142 (ex. Konica Corp.) to obtain 50000 copy papers. These copies were good in image density and fogging, and no filming to the photosensitive material was observed.

Respective papers copy-printed by using the developers from Examples 4, 5 and 6 were permitted to gain access to a mercury lamp (OSRAW-HBO, 250 W) and then were left for 20 minutes. Subsequently, they were rubbed with a brush to partly strip off printed characters and images.

As a comparative example, copy matters obtained from regular toners for U-Bix were set in the same condition and rubbed with a brush, so that no changes were observed.

The above papers exposed to ultraviolet light were measured about amounts of their remaining toners, in accordance with the above-mentioned method. As a result, recycling papers based on papers printed by using the toners of the present invention had substantially no remaining toners, while the recycling papers based on papers printed by using the regular toners had many spots having a size of 100 μm, respectively.

The above results demonstrate that characters and images copy-printed by use of the toners of the present invention were easily degraded by irradiation of ultraviolet light to make recycling of paper easy.

Example 7:

A formulation having the following composition was subjected to a melting and kneading process, so as to obtain toners of the invention. They had an average particle size of 10 μm.

| | (% by weight) |
|---|---|
| Copolymer (a) | 88 |
| Charge controlling agent: TP-302 (ex Hodogaya Chemical Co., Ltd) | 3 |
| Colorant: Lionol Yellow 1206 (C.I.20190) (ex Toyo Ink Manufacturing Co., Ltd) | 4 |
| Wax: Mitsui Hi-Wax HWNP505 (ex Mitsui Petrochemical Industries, Ltd) | 2.5 |
| Additive: Silica RA-200H (ex Nippon Aerosil Co., Ltd) | 0.5 |

Example 8:

Toners of the invention were obtained in the same manner as in Example 7, except that Lionol Blue SM (C.I. 74169, ex. Toyo Ink Manufacturing Co., Ltd) was used instead of the colorant used in Example 7.

Example 9:

Toners of the invention were obtained in the same manner as in Example 7, except that the copolymer (b) was used instead of the resin used in Example 7.

Respective toners obtained in the above-mentioned manners were mixed with carriers coated with a silicone resin, so that the amount of the toners would be 3.5% by weight of the total. Thus, respective developers were obtained.

Respective developers thus obtained from Examples 7–9 were used to obtained developers, so that the amount of the toners would be 3.5% by weight of the total. The respective developers were used to make a continuous copy in a modified machine of commercial available color copying machine Pixel 200 (ex. Canon Inc.) to obtain 20000 copy papers. These copies were good in image density and fogging, and no filming to the photosensitive material was observed. Also, color reproductivity was good.

The above respective papers were permitted to gain access to a mercury lamp (OSRAW-HBO, 250 W) and then were left for 20 minutes. Subsequently, they were rubbed with a brush to strip off almost all of printed characters and images. As a comparative example, copy matters obtained from regular toners for Pixel were set in the same condition and rubbed with a brush, so that no changes were observed.

The above papers exposed to ultraviolet light were measured about amounts of their remaining toners, in accordance with the above-mentioned method. As a result, recycling papers based on papers printed by using the toners of the present invention had substantially no remaining toners, while the recycling papers based on papers printed by using the regular toners had many spots having a size of 100 μm, respectively.

The above results demonstrate that paper copy-printed by the toners of the invention is suitable for recycling of paper and the toners of the invention are excellent in color reproductivity in a color copying machine.

Example 10:

A formulation having the following composition was subjected to a melting and kneading process, so as to obtain toners of the invention. They had an average particle size of 10 μm.

| | (% by weight) |
|---|---|
| Copolymer (a) | 87.1 |
| Charge controlling agent: TP-302 (ex Hodogaya Chemical Co., Ltd) | 3 |
| Colorant: Carbon black #44 (ex Mitsubishi Chemical Corporation) | 6 |

-continued

| | (% by weight) |
|---|---|
| Michler's ketone | 0.9 |
| Wax: Mitsui Hi-Wax HWNP505 (ex Mitsui Petrochemical Industries, Ltd) | 2.5 |
| Additive: Silica RA-200H (ex Nippon Aerosil Co., Ltd) | 0.5 |

Example 11:

Toners of the invention were obtained in the same manner as in Example 10, except that the copolymer (b) was used instead of the resin used in Example 10.

Example 12:

Toners of the invention were obtained in the same manner as in Example 10, except that the copolymer (c) was used instead of the resin used in Example 10 and that N-phenylglycine was used instead of Michler's ketone.

Respective toners obtained in the above-mentioned manners were added into ferrite carriers coated with a silicone resin, so that the amount of the toners would be 3.5% by weight of the total. Thus, respective developers were obtained. The respective developers were used to make a continuous copy in a commercial available copying machine FP-3280 (ex. Matsushita Electric Industrial Co., Ltd) to obtain 50000 copy papers. These copies were good in image density and fogging, and no filming to the photosensitive material was observed.

Respective papers copy-printed by using the developers from Examples 10, 11 and 12 were permitted to gain access to a mercury lamp (OSRAW-HBO, 250 W) and then were left for 10 minutes. Subsequently, they were rubbed with a brush to strip off almost all of printed characters and images. As a comparative example, copy matters obtained from regular toners for FP-3280 were set in the same condition and rubbed with a brush, so that no changes were observed.

The above papers exposed to ultraviolet light were measured about amounts of their remaining toners, in accordance with the above-mentioned method. As a result, recycling papers based on papers printed by using the toners of the present invention had substantially no remaining toners, while the recycling papers based on papers printed by using the regular toners had many spots having a size of 100 μm, respectively.

The characters and images made from the above toners of the invention were especially easily degraded by irradiation of ultraviolet light. Toners of these Examples are especially preferred for recycling of paper.

What is claimed is:

1. An electrophotographic toner comprising a resin, a colorant, a charge-controlling agent and an offset-preventing agent, wherein the resin comprises:

a copolymer of a plurality of monomers, one of said monomers being phenyl isopropenyl ketone or a substituted phenyl isopropenyl ketone in which at least one hydrogen atom of the phenyl group is substituted with alkyl, alkoxy, alkoxycarbonyl, or acyl, each of which has 1–4 carbon atoms, halogen, cyano, nitro, amino, hydroxy, or carboxy, said monomers further comprising styrene and alkyl acrylate, wherein the molar ratio of phenyl isopropenyl ketone or substituted phenyl isopropenyl ketone to styrene monomer to alkyl acrylate monomer is 30–40:20–50:15–50; and a polyester resin, wherein the amount of said copolymer is 30% or more by weight of the weight of said copolymer plus said polyester resin, wherein said toner is removable from a printing material onto which said toners are electrophotographically fixed, by irradiation with light.

2. An electrophotographic toner according to claim 1, wherein the copolymer exhibits photodegradation and adhesion by heat.

3. An electrophotographic toner according to claim 1, wherein the colorant is at least one organic colorant selected from the group consisting of phthalocyanine, quinacridone, benzidine, rhodamine, and insoluble azo compounds.

4. An electrophotographic toner according to claim 1, wherein the colorant is at least either carbon black or blue black pigments.

5. An electrophotographic toner according to claim 1, further comprising a photosensitizer.

6. An electrophotographic toner according to claim 5, wherein the photosensitizer is one or more selected from the group consisting of Michler's ketone, 4,4'-bis(diethylamino)-benzophenone, thioxanthones, N-phenylglycine, N-methylpyrrolidone,1,2,3-triphenylguanidine,N,N-dimethylaniline,piperidine,triethylamine, and dimethylaminoethanol.

7. An electrophotographic toner which can be fixed onto a printing material and can be subsequently removed from the printing material by use irradiating with light and which comprises:

a copolymer of monomers, one of said monomers being phenyl isopropenyl ketone or a substituted phenyl isopropenyl ketone in which at least one hydrogen atom of the phenyl group is substituted with alkyl, alkoxy, alkoxycarbonyl, or acyl, each of which has 1–4 carbon atoms, halogen, cyano, nitro, amino, hydroxy, or carboxy, said monomers further comprising styrene and alkyl acrylate, wherein the molar ratio of phenyl isopropenyl ketone or substituted phenyl isopropenyl ketone to styrene monomer to alkyl acrylate monomer is 30–40:20–50:15–50;

a polyester resin, wherein the amount of said polyester resin is 70% or less by weight of the weight of said polyester resin plus said copolymer;

one or more colorants, at least one of which being selected from the group consisting of phthalocyanine, quinacridone, benzidine, rhodamine, insoluble azo compounds, carbon black, and blue black pigments;

one or more photosensitizers selected from the group consisting of Michler's ketone, 4,4'-bis(diethylamino)-benzophenone, thioxanthones, N-phenylglycine, N-methylpyrrolidone, 1,2,3-triphenylguanidine, N,N-dimethylaniline, piperidine, triethylamine, and dimethylaminoethanol; and a wax as an offset-preventing agent.

8. An electrophotographic toner according to claim 7, wherein the photosensitizer is at least either thioxanthones or N-phenylglycine.

* * * * *